United States Patent [19]

Maeyama

[11] 4,406,618

[45] Sep. 27, 1983

[54] METHOD OF OPERATING CONTINUOUS HEAT TREATMENT FURNACE FOR METAL STRIP COILS

[75] Inventor: Kimio Maeyama, Ashiya, Japan

[73] Assignee: Kawasaki Steel Corporation, Kobe, Japan

[21] Appl. No.: 331,838

[22] Filed: Dec. 17, 1981

[30] Foreign Application Priority Data

Dec. 19, 1980 [JP] Japan ..... 55-180021
Dec. 24, 1980 [JP] Japan ..... 55-181925

[51] Int. Cl.[3] ..... F27B 9/04; F27B 9/16; F27B 5/04

[52] U.S. Cl. ..... 432/23; 266/252; 373/5; 432/138; 432/198

[58] Field of Search ..... 432/23, 138, 198; 373/5; 266/251, 252

[56] References Cited

U.S. PATENT DOCUMENTS 2,504,810 4/1950 Dailey, Jr. ..... 432/198
3,836,320 9/1974 Hemsath et al. ..... 432/138

*Primary Examiner*—John J. Camby
*Attorney, Agent, or Firm*—Balogh, Osann, Kramer, Dvorak, Geneva & Traub

[57] ABSTRACT

A method of operating a continuous heat treatment furnace for metal strip coils includes steps of enclosing them in muffles in the furnace supplied with an atmosphere gas containing a combustible gas such as hydrogen and feeding the muffles into and through the furnace having therein heating, soaking and cooling zones. According to the disclosed method, at least part of the heating and soaking zones is heated by direct firing heating with a fluid fuel with excess air and combustible gas leaked from the muffles into the furnace is burnt in the furnace with the aid of the excess air. Combustible gas leaked from the muffles into the cooling zone is diluted with air forced into the cooling zone to make the combustible gas incombustible and thereafter to exhaust it out of the furnace, thereby eliminating ignition means for the combustible gas in the furnace and particular precaution for preventing an ignition failure.

5 Claims, 8 Drawing Figures

METHOD OF OPERATING CONTINUOUS HEAT TREATMENT FURNACE FOR METAL STRIP COILS

BACKGROUND OF THE INVENTION

1. Field of the Invention

This invention relates to a method of operating a continuous heat treatment furnace for metal strip coils, and more particularly to a method of operating a continuous heat treatment furnace effectively eliminating harmful phenomena occurring in the furnace in an inexpensive manner.

2. Description of the Prior Art

In heat treating, inter alia annealing in a non-oxidizing atmosphere coiled metallic materials, particularly rolled steel strips, inter alia silicon steel strips, atmosphere gases including combustible gases such as hydrogen or carbon monoxide are often used. In this case, the coils are covered by muffles into which the atmosphere gas is supplied and are indirectly heated by electric heaters or radiant tubes arranged out of the muffles.

A skirt of the muffle is usually sealed by a so-called sand seal, ceramic wool seal or the like, so that it is difficult to completely seal the muffle. Nevertheless, a sophisticated seal cannot be used for this purpose, because of the requirement of the muffle to be handled in a simple and easy manner. Therefore, the atmosphere gas supplied in the muffle during the heat treatment tends to escape through the seal at the skirt of the muffle into a heat treatment furnace, with the result that the escaped gas forms in the furnace an atmosphere similar to that in the muffle. When the atmosphere in the muffle for the heat treatment includes hydrogen as above described, the gas in the furnace includes hydrogen and, therefore, there is a risk of explosion caused by the gas at a high temperature in the furnace when it contacts the open air, in case of particularly continuous furnace wherein a great number of strip coils are in succession charged into and fed through the furnace while the coils are being subjected to the heat treatment.

To solve this problem, a continuous furnace 1, typically shown in FIGS. 1 and 2 as a trolley tunnel furnace, has been provided at an inlet and an outlet with double shutoff doors 2 and 3 to form shutoff chambers 4 and 5, respectively. With this arrangement, however, complicated operations are required in which gases in the shutoff chambers 4 and 5 are replaced by an inert atmosphere, for example, nitrogen gas every time when the strip coils are charged into and discharged from the furnace. Moreover, in order to ensure positive sealing of the double shutoff doors and around pipe lines 6 and wires 7 passing through walls of the furnace as shown in a cross-section of the tunnel furnace shown in FIG. 2, a particular caution is required, which makes complicated the furnace structure. In FIGS. 1 and 2, strip coils 11 are enclosed in muffles 9 whose skirts are sealed by seals 10 settled in trolleys 8 and are heated by electric heaters 12 and supplied with heat treatment atmosphere gas through a supply tube 13 having couplings 14 for detachably connecting the tube 13 to the pipe lines 6.

In addition, when an atmosphere gas containing hydrogen leaks out of the muffle into the furnace, the gas penetrates the furnace walls to adversely affect their adiabatic or thermal insulating property resulting in a lower thermal efficiency of the furnace. In consideration of such a leaked atmosphere gas including a combustible gas, even carbon monoxide, penetrating the walls of the furnace, a positive sealing for a gas in the furnace is also required as in the muffle to prevent the gas from escaping out of the furnace in view of safety and sanitation.

The company to which the inventor of this application belongs has been investigated and developed a system as disclosed in Japanese Laid-open Patent Application No. 96,408/79 in which preheated air is introduced into a furnace to ignite and burn combustible components in a gas in the furnace, thereby making the gas in the furnace harmless, which brings about many advantages. However, as a cooling zone is generally at a temperature lower than a heating zone, a particular precaution is needed in order to absolutely ensure the ignition and combustion of the combustible components.

SUMMARY OF THE INVENTION

It is therefore a primary object of this invention to provide an improved method of operating a continuous heat treatment furnace for metal strip coils, which makes it possible to treat leaked combustible gases in the furnace in a more suitable and simple manner, by dividing a heating and a uniform heating or soaking zone at high temperatures and a cooling zone at low temperatures of the furnace into a high and a low temperature zone, in which high temperature zone comparatively inexpensive direct firing heating with a fluid fuel is used, and in which high temperature zone leaked combustible gas is diluted with air supplied into the furnace so as to be able to exhaust out of the furnace, thereby eliminating igniting means and precaution for preventing an ignition failure.

It is another object of the invention to provide a method of operating a continuous heat treatment furnace for metal strip coils, carrying out suitable heat treatment inexpensively by using comparatively cheap direct firing heating with a fluid fuel in an earlier half zone in a heating and a uniform heating or soaking zone, where heating rate is out of the question and by using indirect heating in a later half zone where control of heating rate is needed.

In order to achieve these objects, the method of operating a continuous heat treatment furnace including steps of enclosing metal strip coils, which have been wound after rolled, in muffles supplied therein with an atmosphere gas containing a combustible gas such as hydrogen and feeding the muffles into and through the furnace divided in heating, soaking and cooling zones by an intermediate door to subject the coils to heating, soaking and cooling, wherein at least part of the heating and soaking zones is heated by direct firing heating with a fluid fuel with excess air and combustible gas leaked from the muffles into the furnace is burnt in the furnace with the aid of the excess air, while an amount of air is supplied into the cooling zone so as to dilute combustible gas leaked from the muffles into the cooling zone to render it incombustible and thereafter to exhaust it out of the furnace.

The fluid fuel used in carrying out the method according to the invention may be a gas fuel such a coke gas or a liquid fuel such as heavy oil.

The invention will be more fully understood by referring to the following detailed specification and claims taken in connection with the appended drawings.

DETAILED DESCRIPTION OF THE PREFERRED EMBODIMENT

Figure 1:
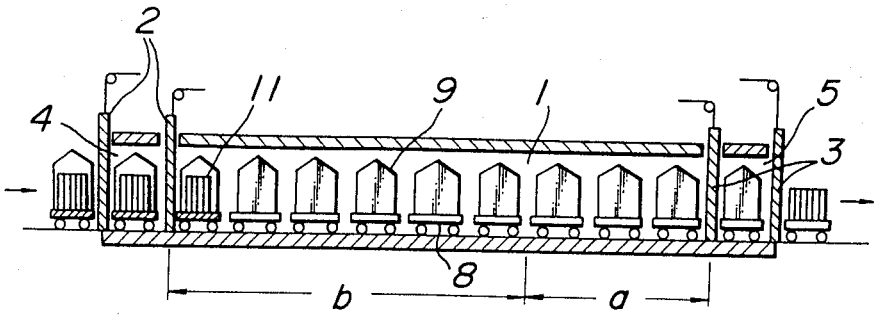
FIG. 1 PRIOR ART
FIG. 1 is a longitudinal sectional view of a prior art continuous heat treatment furnace as mentioned above.
Figure 2:
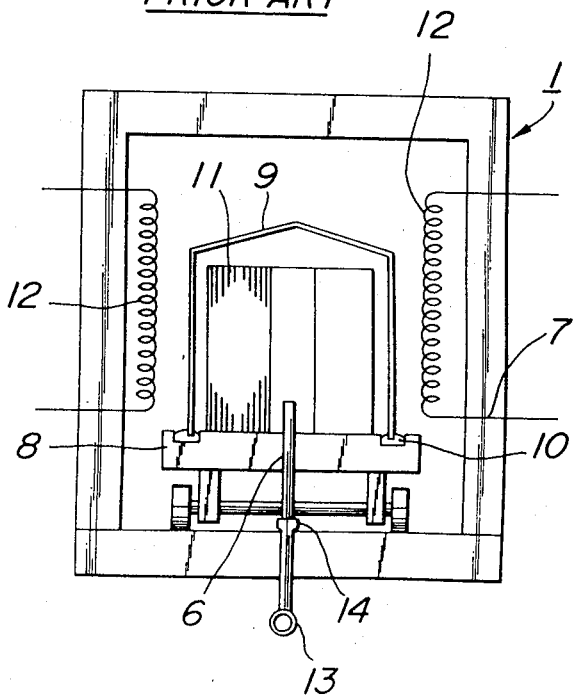
FIG. 2 PRIOR ART
FIG. 2 is an enlarged cross-sectional view of the furnace shown in FIG. 1 as mentioned above.

A preferred embodiment of the invention is typically embodied in a rotary furnace floor type continuous heat treatment furnace as shown in the drawings FIGS. 3–6. In this embodiment, a direct heating system is applied in an earlier half of a heating zone and an indirect heating system is applied in a later half of the heating zone and a uniform heating or soaking zone.

Instead of the double shutoff doors 2 and 3, and hence the shutoff chambers 4 and 5 indispensable for the prior art, the furnace is provided with shutoff doors 2' and 3' in the form of a single plate and an intermediate door 15 dividing an interior of the furnace into a low temperature zone a and a high temperature zone b. Inner and outer walls in the heating and soaking zones are provided in the direct heating zone with direct firing burners 12' and in the indirect heating zone with electric heaters 12 as heating means, spaced apart by suitable distances, respectively. A plurality of air inlets 16 are provided at the lower furnace structure in the indirect heating zone and a cooling zone, respectively. At the top of the furnace are provided exhaust pipes 17 for exhausting out of the furnace combustion exhaust gases from the heating and uniform heating zones and cooling gases from the cooling zone with the aid of an exhaust gas fan 18 through a stack 19. The air is preferably independently supplied to the heating and cooling zones. However, a common air supply source may be used, if it is possible to distribute air supply amounts in a manner as described later.

With this arrangement, the strip coils 11 located on the rotary furnace floor 8' and enclosed in the muffles 9 filled with the atmosphere gas are passed progressively from the heating zone to the cooling zone with the movement of the rotary furnace floor 8' to be subjected to the predetermined heat treatment.

If it is desired to heat all the heating and soaking zones by direct firing heating, the electric heaters for the indirect heating may be replaced by the burners.

Figure 7:
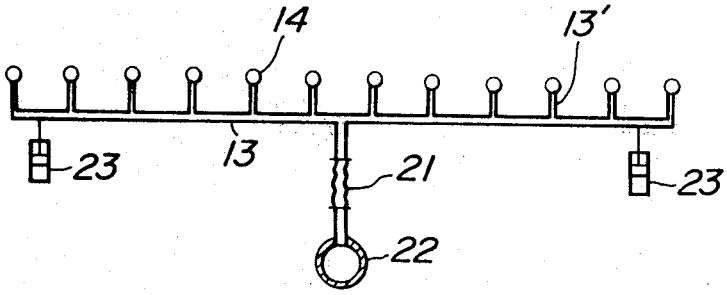
FIG. 7 illustrates a pipe line system used in the furnace shown in FIG. 3 for supplying atmosphere gas into muffles.

FIG. 7 illustrates one example of coupling systems for supplying the heat treatment atmosphere gas through a supply pipe 13 and pipe lines 6 into the muffle 9. To a gas source tube 22 is connected by means of a flexible tube 21 the supply pipe 13 including branch pipes 13'. Each branch pipe 13' is provided with a coupler 14 adapted to be coupled in an air-tight manner to one of pipe lines 6 depending from the furnace floor 8' with a predetermined interval. For connecting and disconnecting the coupler 14 lift cylinders 23 are provided. With the supply pipes 13 lowered by the lift cylinders 23 in their lowermost positions, the rotary furnace floor 8' is rotated in a stepwise manner without any interference with the supply pipes 13. An automatically closing valve is preferably provided in each coupler 14 for controlling the supply and stop of the gas.

In operating the continuous furnace constructed as above described, in the burner directly heating zone which is the earlier half of the heating zone, the strip coils 11 are heated under the protection of the muffles 9 by means of the burners 12' with excess air which is more than the theoretically required amount of air. Under such burning conditions, oxygen exists in the gas in the furnace, so that the combustible atmosphere gas escaped through the seals at the skirts of the muffles 9 into the furnace will be immediately burnt with the aid of the oxygen so as to be harmless.

In this case, it should be noted that as burning conditions of hydrogen gas, a firing temperature is higher than 572° C. for a hydrogen gas having a concentration of 4–74% (in the atmosphere). It should also be understood that the temperature in the furnace must be maintained more than 572° C. all over the heating and soaking zones, and the oxygen sufficient to completely burn the hydrogen gas leaked in the furnace must be provided thereinto by the excess air for the burners 12'. The exhaust gas of the burners for heating the furnace and the burned gas of the leaked combustible gas are exhausted together through the exhaust pipes 17 arranged at the top of the furnace into the stack 19 by means of the suction fan 18.

Figure 3:
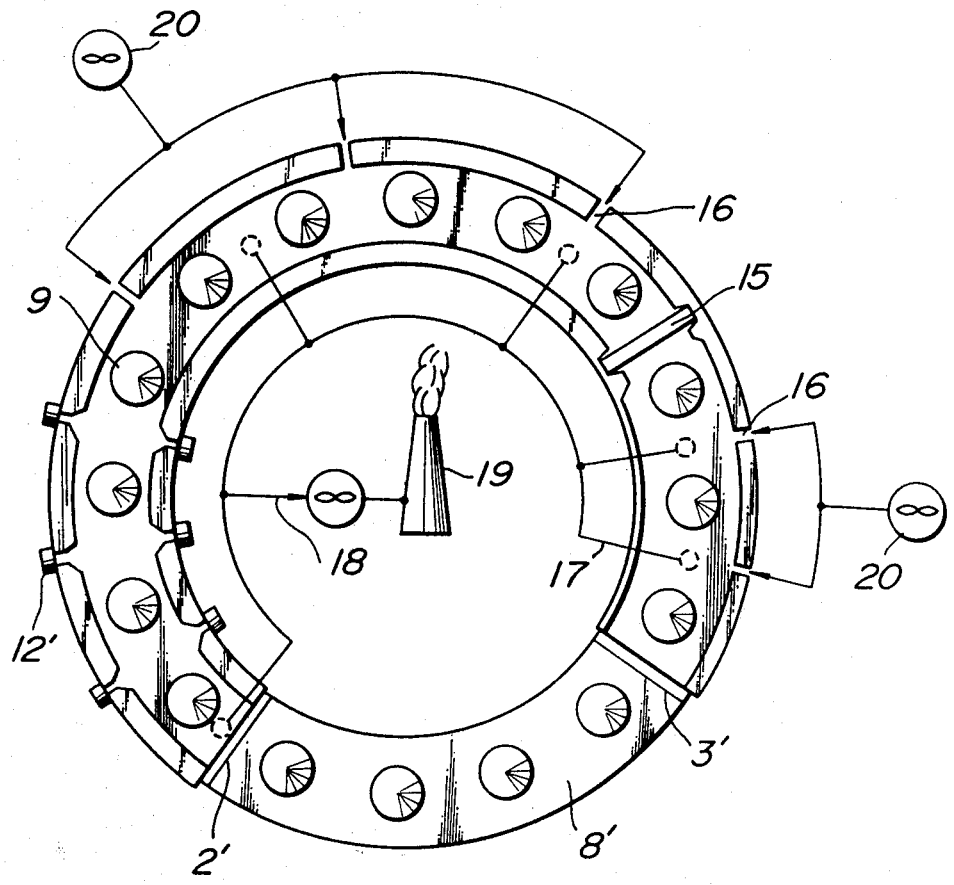
FIG. 3 is a schematic sectional plan view of a rotary floor type continuous heat treatment furnace illustrating a preferred embodiment of the invention.
Figure 4:
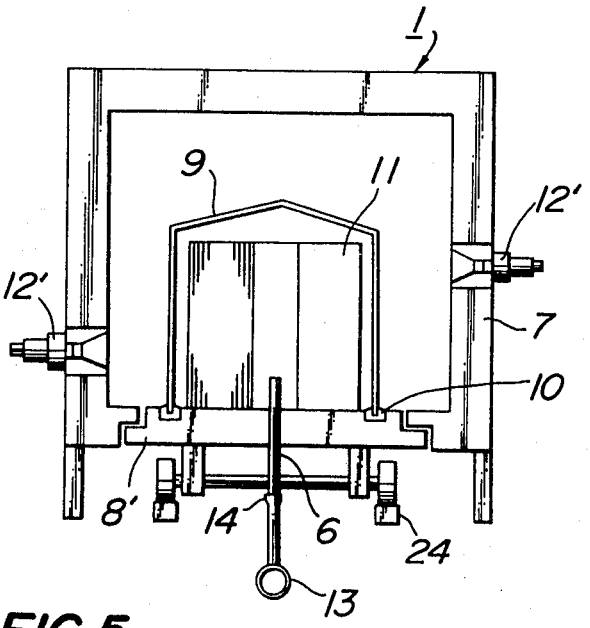
FIG. 4 is a sectional view of a direct heating zone of the furnace shown in FIG. 3.
Figure 5:
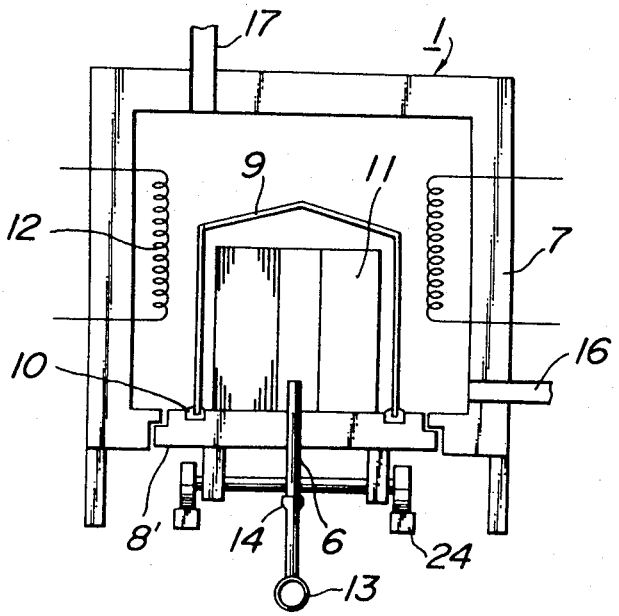
FIG. 5 is a sectional view of an indirect heating zone of the furnace shown in FIG. 3.
Figure 6:
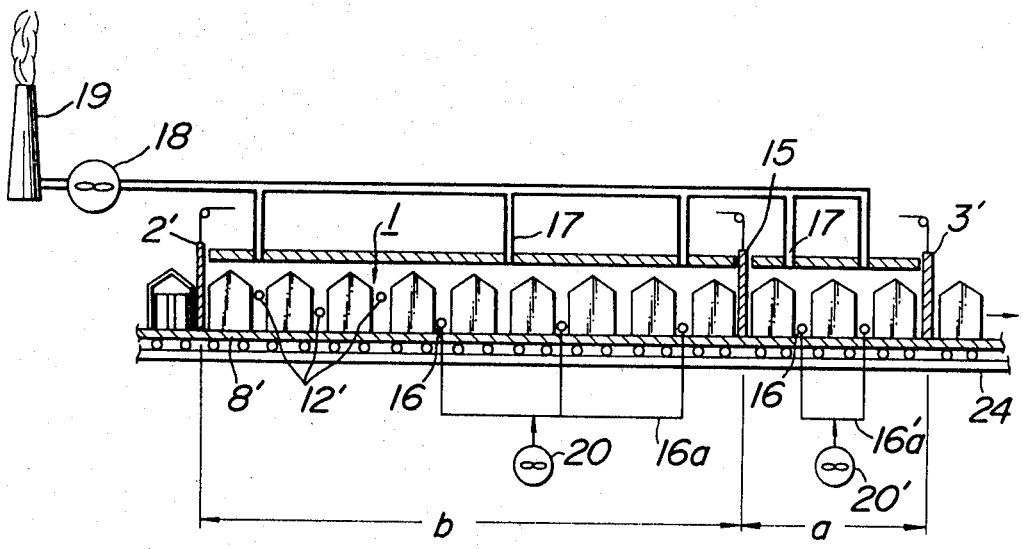
FIG. 6 is a development view of the rotary floor type continuous heat treatment furnace shown in FIG. 3.

In the event that two burners having a capacity of 75,000 Kcal/hour are provided on each the muffle as shown in FIGS. 3 and 4 and the hydrogen gas of 0.5–5 $m^3$/hour is supplied to each the muffle, an example of the combustion with coke gas in the earlier half of the heating zone is as follows:

Calorific value of coke gas:
$H = 4{,}350$ Kcal/$Nm^3$

Used coke gas at maximum load:
$75{,}000/4{,}350 = 17.2$ ($Nm^3$/hour)

Theoretical air amount:
4.455 $Nm^3$-air/$Nm^4$-coke gas

Combustion gas amount:
5.158 $Nm^3$/$Nm^3$-coke gas

Oxygen amount required for complete combustion of hydrogen:
0.5 $Nm^3$-$O_2$/$Nm^3$-$H_2$ Air amount required for complete combustion of hydrogen:
2.38 $Nm^3$-air/$Nm^3$-$H_2$ The fact that the concentration of the hydrogen for the combustion thereof is 4–74% which is a ratio to the air means that the oxygen is 0.08–5 in a ratio to hydrogen which is assumed 1 (one). If the oxygen is 0.08–0.5 in the ratio to hydrogen (one), only 0.16–1 of the hydrogen is burnt and thus unburnt hydrogen remains. In order to completely burn the hydrogen, the oxygen must be 0.5–5 in the ratio to the hydrogen (one). This amount of oxygen corresponds to 2.38–23.8 of the air.

Assuming that the hydrogen of 2 $Nm^3$/hour is supplied into the muffle, the required air amount is calculated as $$(2.38 \text{ to } 23.8)\times 2 = 4.76 \text{ to } 47.6 \text{ Nm}^3/\text{h}$$

At this time, excess air ratios (m) are $$m = \frac{17.2 \times 4.455 + \frac{4.76}{2}}{17.2 \times 4.455} \text{ to } \frac{17.2 \times 4.455 + \frac{47.6}{2}}{17.2 \times 4.455} = 1.03 \text{ to } 1.31$$

(at maximum combustion load)

$$m = \frac{17.2 \times \frac{1}{2} \times 4.455 + \frac{4.76}{2}}{17.2 \times \frac{1}{2} \times 4.455} \text{ to } \frac{17.2 \times \frac{1}{2} \times 4.455 + \frac{47.6}{2}}{17.2 \times \frac{1}{2} \times 4.455} = 1.06 \text{ to } 1.62$$

(at one half combustion load)

$$m = \frac{17.2 \times \frac{1}{4} \times 4.455 + \frac{4.76}{2}}{17.2 \times \frac{1}{4} \times 4.455} \text{ to } \frac{17.2 \times \frac{1}{4} \times 4.455 + \frac{47.6}{2}}{17.2 \times \frac{1}{4} \times 4.455} = 1.12 \text{ to } 2.24$$

(at one fourth combustion load)

$$m = \frac{17.2 \times \frac{1}{10} \times 4.455 + \frac{4.76}{2}}{17.2 \times \frac{1}{10} \times 4.455} \text{ to } \frac{17.2 \times \frac{1}{10} \times 4.455 + \frac{47.6}{2}}{17.2 \times \frac{1}{10} \times 4.455} = 1.31 \text{ to } 4.10$$

(at one tenth combustion load)

The burners in the heating zone are normally used under the full to one fourth combustion load, and therefore if the excess air ratio is kept at the most m=1.2, the oxygen required and sufficient to completely burn the leaked hydrogen gas can be supplied.

The air amount to be supplied to the electric heating zone in the later half of the heating zone and soaking zone may be that sufficient to burn the combustible gas leaked from the muffle. In the case that hydrogen gas is used as a combustible gas, therefore, the air amount is 2.38–23.8 $m^3$ per 1 $m^3$ hydrogen gas as above described.

In the cooling zone, on the other hand, the hydrogen gas leaked at the skirt of the muffle 9 is diluted with a great amount of air forced through the air inlets 16 to a concentration value less than 4% which is a lower limit value for burning the hydrogen gas, so that the mixture thus containing the hydrogen gas is exhausted without combustion through the exhaust pipes 17 and the stack 19 into the air. In other words, the air amount to be blown into the cooling zone should be more than 24 $m^3$ per 1 $m^3$ hydrogen. When 0.5–5 $m^3$/hour of hydrogen is supplied, the minimum value of the air supply is 120 $m^3$/hour which is obtained by a calculation of x in an equation $5/(5+x)=0.04$.

Accordingly, if a fan 20' having a supply capacity of 120 $m^3$/hour is used, sufficient air can be supplied into the furnace without any control of the fan and all that is required for safety is to provide a spare fan and a diesel generator as a power source for an interruption of service.

Figure 8:
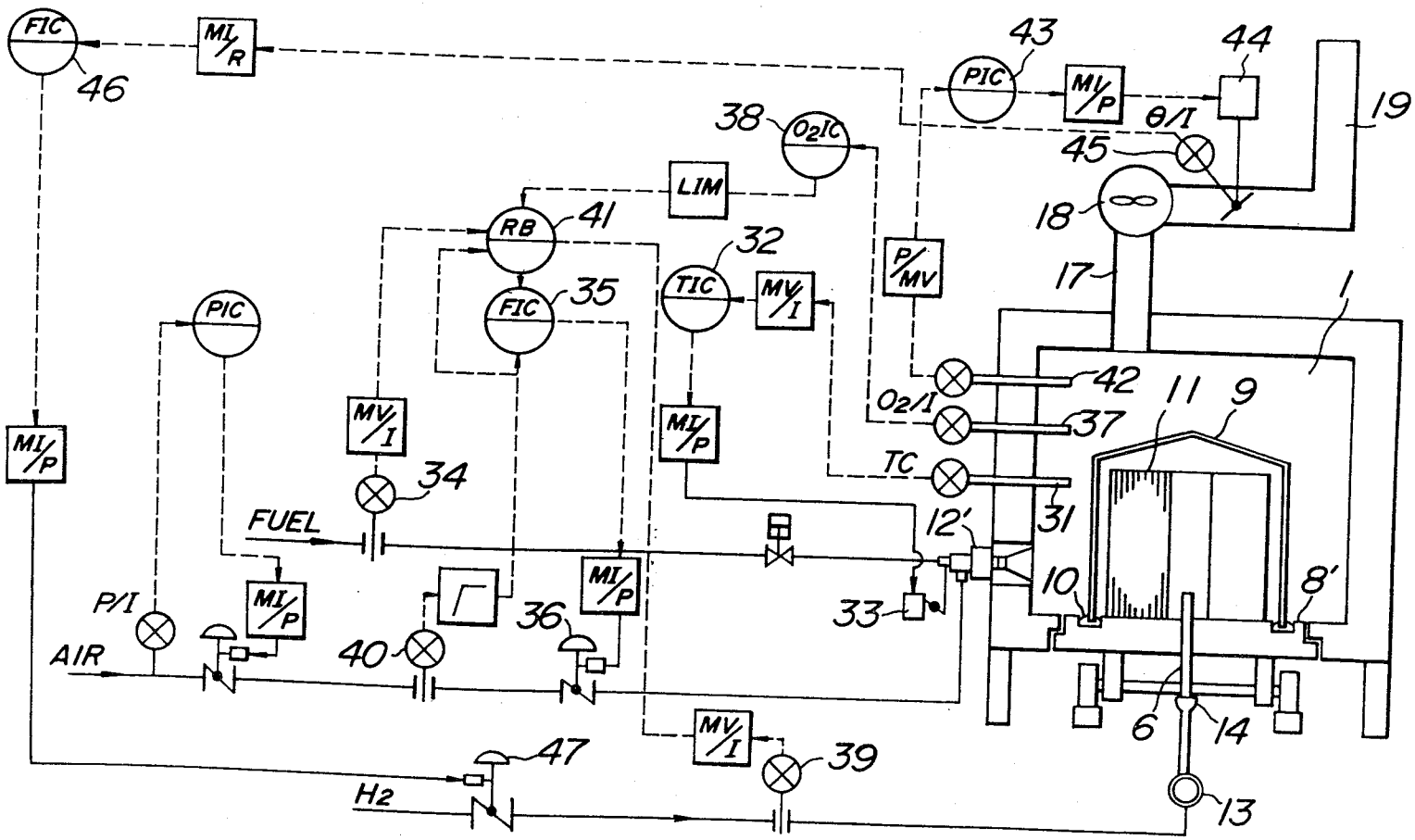
FIG. 8 is a typical control circuit for heating the direct heating zone of a furnace in carrying out the invention.

FIG. 8 illustrates one example of a control circuit for heating operation in the direct heating zone of the above continuous furnace. The temperature in the furnace is measured by a furnace temperature determining couple 31 from which temperature signal is fed to a temperature regulator (TIC) 32 whose output drives a control motor 33 for regulating opening of the burner fuel valve to control the temperature in the furnace. A fuel flow meter 34 senses the fuel flow to generate a signal which is fed to an air flow regulator (FIC) 35 whose output actuates an air regulator valve 36 to ensure the air amount required for combustion depending upon the change in fuel flow. In order to obtain a more complete control, by the use of the supplied air amount guessed by an oxygen analyzer ($O_2$/I) 37 and an oxygen percentage regulator ($O_2$IC) 38, the supplied hydrogen gas to the muffle measured by an orifice 39 located in a hydrogen gas supply system, the air amount determined by an orifice 40 arranged in an air supply pipe for combustion and the fuel amount determined by the fuel flow meter 34 as above described, the required air amount is determined by arithmetic operation in a ratio bias unit (RB) 41 which feeds a signal to the air flow regulator 35 whose output determines the opening of the air regulator valve 36 to ensure the required air amount.

If the pressure in the muffle is unintentionally negative, the air tends to enter the muffles through cracks in furnace bottom bricks so as to prevent a complete heat treatment. To solve this problem, the following control system may be provided to ensure the positive pressure in the muffles, notwithstanding the muffles on trolleys are movable.

Referring again to FIG. 8, there is provided a conventional furnace pressure control system wherein a furnace pressure detector 42 monitors the variation in the pressure in the furnace to feed a signal to a regulator 43 whose output drives a control motor 44 which closes and opens a damper located in a passage of a stack 19 to maintain the pressure in the furnace constant. Furthermore, an additional control system is provided in which a position meter 45 for detecting the opening of the damper is directly connected to the damper, and within the range of the opening of the damper larger than almost the full opening, a gas flow regulator 46 for computing the increase in atmosphere gas with respect to the damper opening controls an atmosphere gas flow control valve 47, thereby varrying the gas flow.

Although the above control systems are described to use the analogue instruments, it may of course be possible to use digital systems for this purpose.

In the above description, although the invention has been explained in the application to the rotary furnace floor type continuous heat treatment furnace, the invention can be applied to a straight trolley tunnel furnace in the same manner. In this case, however, the rotary type furnace is desirable, if it is difficult to keep hot the trolleys returning from an outlet to an inlet of the trolley tunnel furnace.

The combustible gas is of course not limited to the hydrogen gas. Other combustible gases such as carbon monoxide may be used in a furnace to which the invention is applied.

The effects of the invention are summarized as follows:

1. In the conventional furnace, it is required to provide an inlet chamber and an outlet chamber defined by operable double shutoff doors at an inlet and an outlet of the furnace and a great amount of inert gas such as nitrogen filled in the chambers in order to avoid a direct contact of the combustible gas such as hydrogen leaked from a muffle into the furnace with the air, and seals for the double shut-off doors from the air, which doors separate the inlet and outlet chambers from the interior of the furnace and seals for pipe lines and wires from the outside to inside of the furnace such as pipes for supplying the atmosphere gas and furnace temperature measuring couples are complicated in their construction. In contrast herewith, this invention achieves the simplicity of the furnace construction.

2. In general, a thermal conductivity of a thermal insulating material in a hydrogen atmosphere is higher than and 2–2.7 times as much as the thermal conductivity in the air or combustion gas, so that dissipated heat derived from a furnace body is great. According to the invention, however, even if hydrogen gas is used as the atmosphere gas, it does not remain in a furnace, so that its thermal efficiency is greatly improved.

3. According to the invention, a quantity of heat 2,572 Kcal/$Nm^3$-$H_2$ resulting from the combustion of hydrogen gas can be utilized for raising the temperature in the furnace. In case that coke gas is used as a fuel, therefore approximately 0.6 $m^3$ of coke gas can be saved per 1 $m^3$ of hydrogen gas. In case of kerosene, about 0.3 liter thereof can be saved per 1 $m^3$ of hydrogen gas. Accordingly, the invention greatly contributes to the economy of energy.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In a method of operating a continuous heat treatment furnace, which furnace is divided by an intermediate door into heating, soaking and cooling zones, said method including steps of enclosing metal coils, which have been wound after being rolled, in muffles, and supplying the muffles with an atmosphere gas containing hydrogen gas, and feeding the muffles into and through the furnace so as to subject said coils to heating, soaking and cooling, the improvement which comprises heating at least part of said heating and soaking zones by direct firing-heating with a fluid fuel with excess air, burning in the furnace with the aid of said excess air combustible gas leaked from the muffles into the furnace, supplying an amount of air into said cooling zone so as to dilute combustible gas leaked from the muffles into said cooling zone and render it incombustible, and exhausting thereafter the incombustible gas out of the furnace.

2. An improved method as set forth in claim 1, wherein all said heating and soaking zones are heated by direct firing heating with the fluid fuel with excess air.

3. An improved method as set forth in claim 1, wherein an earlier half of the heating and soaking zones is heated by direct firing heating with the fluid fuel with excess air.

4. An improved method as set forth in claim 1, wherein in a zone subjected to an indirect heating other than the zone subjected to the direct firing heating, the combustible gas leaked from said muffles into said furnace is burnt with the aid of air forced into said furnace.

5. An improved method as set forth in claim 1, including burners with coke gas or heavy oil and electric heaters, wherein the heating step comprises effecting said direct firing-heating by said burners and carrying out other heating by said electric heaters.

* * * * *